US005267598A

United States Patent [19]

Marocco

[11] Patent Number: 5,267,598

[45] Date of Patent: Dec. 7, 1993

[54] WINDOW COVERING CONTROL APPARATUS AND WINDOW COVERING ASSEMBLY

[76] Inventor: Norbert Marocco, 46 Pennycross Court, Woodbridge, Ontario, Canada, L4L 3M6

[21] Appl. No.: 911,487

[22] Filed: Jul. 10, 1992

[51] Int. Cl.[5] ..... E06B 9/26

[52] U.S. Cl. ..... 160/177; 160/176.1

[58] Field of Search ..... 160/176.1, 178.11, 177, 160/174, 166.1

[56] References Cited

U.S. PATENT DOCUMENTS

| | | | |
|---|---|---|---|
| 3,269,453 | 8/1966 | Vecchiarelli et al. | 160/176.1 |
| 3,333,905 | 8/1967 | Hennequin . | |
| 3,425,479 | 2/1969 | Lorentzen . | |
| 3,828,838 | 8/1974 | Anderle . | |
| 4,406,319 | 9/1983 | McNiel . | |
| 4,487,243 | 12/1984 | Debs | 160/176.1 X |
| 4,494,593 | 1/1985 | Fiedler, Jr. | 160/177 |
| 4,621,673 | 11/1986 | Georgopoulos . | |
| 4,628,979 | 12/1986 | Hsu | 160/176.1 X |
| 4,643,238 | 2/1987 | Tachikawa . | |
| 4,697,629 | 10/1987 | Anderson | 160/177 |
| 4,821,789 | 4/1989 | Van Rens | 160/176.1 |
| 4,875,516 | 10/1989 | Marocco . | |
| 5,139,073 | 8/1992 | Ophdahl et al. | 160/176.1 X |

FOREIGN PATENT DOCUMENTS

| | | | |
|---|---|---|---|
| 2805469 | 8/1978 | Fed. Rep. of Germany . | |
| 1298561 | 6/1962 | France | 160/176.1 |
| 1017005 | 1/1966 | United Kingdom | 160/176.1 |

*Primary Examiner*—Blair M. Johnson

[57] ABSTRACT

A control apparatus for a window covering having a head rail from which the window covering is suspended, having a rotatable control shaft along the length of the head rail, attachment drum bodies on the shaft at spaced intervals for attachment of the suspension cords, openings in the drum bodies for receiving the cords, a slot formed along the drum bodies by which they may be positioned on the control shaft, and a window covering incorporating such a control apparatus.

14 Claims, 2 Drawing Sheets

WINDOW COVERING CONTROL APPARATUS AND WINDOW COVERING ASSEMBLY

FIELD OF THE INVENTION

The invention relates to a control structure for use in window coverings such as, for example, venetian blinds of the type having horizontal slats which may be raised and lowered and which may be tilted to and fro to open and close the blinds and in which the blinds are carried on "ladder tapes", and in particular to apparatus for securing and controlling such ladder tapes.

BACKGROUND OF THE INVENTION

Various kinds of window coverings exist, wherein a window covering, for example, a plurality of blind slats, in the case of venetian blinds, or some other form of window covering material such as drapery material or the like in certain other kinds of window covering, must be adjusted or controlled from above in various ways.

In particular, venetian blind structures are well known consisting of a head rail supported typically in a window or in an opening. A series of horizontal slats are suspended beneath the head rail. They are carried on what are known in the trade as "ladder tapes" or simply "ladders". In addition, suspension cords, or "raise" cords, pass through openings in the slats, to the lowermost slat. Raising and lowering of the suspension cords permits the slats to be raised and lowered. The ladder tapes are pairs of cords or tapes with spaced apart transverse flexible elements somewhat in the manner of rope ladders. The tapes actually support the weight of the individual slats and separate them from one another. At their upper ends in the head rail, the ladder tapes are secured in such a manner, to a tape control rod, that the tapes on one side of the slats may be wound up, while the tapes on the other side of the slats are unwound. In this way, the slats can be tilted from the horizontal to an almost, but not completely, vertical position and back again. Usually, they can be tilted either way from the horizontal, to provide various effects of light and shade within a room.

In the past, numerous different designs of ladder tape controls have been provided in different makes of blinds. Generally speaking, a transverse control shaft extends along most of the length of the headrail, and is operated by a drive at one end of the head rail. Usually a worm and wheel gear drive is used, operated by means of a wand. In some cases, a direct drive is provided, operated simply by means of an endless chain, driving a sprocket keyed directly to the control shaft.

In whatever manner, some means are provided for rotating the transverse control shaft to and fro through a predetermined arc, usually slightly less than 180 degrees, although a greater rotation may be required depending upon the width of the slots, and the diameter of the shaft.

The vertical cords or tapes of the two ladder tapes were attached in some fashion to the shaft, so that when the shaft was in the mid position, i.e., at about the 90 degree rotational position, the two ladder tapes were of equal length. In this way, the "rungs" of each of the ladder tapes were essentially horizontal, so that the blind slats were horizontal and were thus "open". As the shaft was rotated one way or the other, the rungs then tilted one way or the other, causing tilting of the actual slats in the same fashion.

The actual manner in which the cords were attached to the shaft varied from one manufacturer to another. In order to provide for an adequate degree of tilting movement of the slats themselves, i.e., from a more or less vertical position on one side to a more or less vertical position on the other side, it was desirable to provide some form of drum device on the shaft, to which the two ends of the ladder tapes or cords could be attached. The drum device would usually have a predetermined diameter greater than that of the shaft itself. In this way, partial rotation of the shaft would provide an adequate degree of movement of the cords themselves, so as to produce a complete tilting movement of the slats from one extreme tilt to the other. Obviously, for reasons of economy it was desirable to have a control shaft of a simple economical slender design to take up a minimum of space and use a minimum of material, and yet to have actual tape drums of adequate diameter, to produce a sufficient degree of movement of the cords for the purpose.

Various problems arise in the design of such drum devices. For example, it is necessary that, in some way, the drum be keyed to the shaft so that when the shaft is rotated the two or more drums supporting the two or more sets of ladder tapes or cords will all be rotated in unison. The drums must be held at a predetermined height along the length of the head rail, so as to maintain the blind slats level. Some form of attachment means must be provided for a quick attachment of the cords to the drums, so that during assembly, workers do not have to spend excessive time on insuring that the lengths of cord are equalized as between two or more drums. If there is any inequality in the length of the pairs of cords, then the blind will not hang level.

All of these features must be provided in low cost parts which are simple and economical to manufacture and for which the tooling cost is a minimum, and which are adaptable to blinds of a variety of different sizes.

Another problem that arises in the design of such venetian blinds is the provision of bearings within the head rail to carry the shaft. It is, for example, not uncommon to attempt in some way to associate bearing devices with the drums carrying the cords, so that the assembly on the shafts is simplified. However, not only is it necessary to assemble the bearings and the drums on the shafts, it is also then necessary to place the shaft, with its bearings and drums, on complimentary bearing supports located in the head rail. It is also necessary to do this by such means that the shaft is retained in position in the head rail so that it cannot inadvertently spring upwardly due, for example, to over vigorous rotation of the shaft, by a user.

It must also be borne in mind that the ladder cords or tapes will, in fact, pass through openings in the head rail, downwardly, so as to support the slats below the head rail. Usually the head rail is also made of sheet metal, and any openings will have relatively sharp edges. It is, therefore, desirable to provide some form of anti-friction guide means within the head rail, registering with the holes in the head rail, through which the ladder cords can pass, so that wear on the cords is reduced to a minimum, thereby prolonging the useful life of the blinds.

It will also be remembered that such venetian blinds also have cords for raising and lowering the entire set of horizontal slats. As explained, this is usually achieved by means of what are known as "raise" cords, which pass downwardly through openings in the head rail and downwardly through openings in successive slats, and are fastened at a lower most slat member.

Usually there are two raise cords, and they pass through a frictional cord lock pulley device at one end of the head rail. Pulling on the two cords together will raise the blind, and releasing the two cords from the cord lock will permit the blind to be lowered. Again, it is highly desirable to provide some form of anti-friction guide means in the head rail, for guiding the raise cords, during their movement so as to minimize wear, and thereby prolong the useful life of the blind.

In the past, one of the commonest designs of drum and bearing systems for the ladder cords has been based on a combination of a sleeve of generally thermoplastic material slid on the shaft, and a more or less cylindrical band of sheet metal material clamped around the thermoplastic sleeve. The band of thermoplastic material was formed with struck-out tongues. The ends of the cords could be placed under the tongues which were then squeezed flat, thereby holding the cords in position. However, the design of the bearing supports in the head rail, which were used in combination with this system, provided two spaced-apart closed bearing rings to retain the control rod in position.

The assembly of the control rod into these two bearings each with closed bearing rings presented a tedious problem. A first thermoplastic sleeve with its clamping cord sleeve around it was placed on the control rod. The control rod was then slid through a first one of the bearing rings. A further sleeve was then placed on the control rod with a further cord clamping sleeve on that plastic sleeve, and that was then slid into the second of the bearing rings. When the rod and the various sleeves were then in Position in the bearing rings, the ladder cords could then be led upwardly through openings in the head rail, and wrapped around the drums, hooked under the sheet metal tongues which were then flattened to hold the cords in position. This assembly work required considerable skill and considerable time. If any mistake was made in clamping of one or other of the cords in position, then the blind would never hang level, and it was necessary to send a service man to correct the problem. Not infrequently, one or more of the cords would become loose from having been inadequately clamped underneath such a tongue, again requiring service calls.

The apparatus, therefore, required several different parts some made of thermoplastic and some made of sheet metal, and required a lengthy and complex assembly process, which had to be carried out in a precise order, and with considerable skill exercised at various stages, in order to produce a satisfactory result.

The net result increased the overall cost of the blinds to an unacceptable extent.

Clearly, it would be advantageous to provide a system wherein the drum devices can be assembled on the shaft, independently of the head rail. Advantageously the assembly of the drum devices and the shaft can then be inserted in suitable bearing supports in the head rail, and then finally the cords can be placed in position, adjusted to length easily and readily, and securely clamped, by finger pressure. Preferably all of the parts will be manufactured of thermoplastic material so that special tools for clamping sheet metal parts will not be required, the clamping being achieved simply by a frictional interference fit between two plastic parts clamping the cords.

In addition, advantageously such a system will incorporate anti-friction means for guiding both the ladder cords and also the raise cords, without the provision of additional parts requiring extra assembly operations.

As noted above, while the invention is of particular application to venetian blinds having slats which must be tilted to and fro, it is also of application to other forms of window covering devices.

BRIEF SUMMARY OF THE INVENTION

With a view to satisfying the various conflicting problems described above, the invention comprises a control apparatus for use in association with a window covering assembly comprising a head rail, and suspension means extending downwardly from said head rail upon which said window covering is suspended, said control apparatus being required for the adjustment and movement of said suspension means, and said control apparatus comprising a control shaft adapted to extend a predetermined distance along the length of said head rail, and means associated therewith for rotating the same, suspension opening means in said head rail whereby suspension means may extend upwardly from said window covering into said head rail, attachment drum body means, attachable on said shaft at spaced intervals therealong, and adapted to register with said openings for said suspension means in said head rail, opening means in said drum body means for receiving said suspension means therethrough, a generally elongated slot formed along said drum body means, whereby the same may be Positioned on said control shaft, and, cord clamping means associated with said drum body means to clamp said suspension means, whereby upon rotation of said shaft, said suspension means may wind around said drum body means.

The invention further comprises such a control apparatus and wherein said drum body means incorporates bearing means extending therefrom, and including bearing support means adapted to be supported in said head rail, and inter-engagable with said bearing means on said drum body means whereby to rotatably support the same.

The invention further comprises such a control apparatus and wherein said drum body means incorporate a bottom wall and side walls, said opening means being formed in said bottom wall, and notch means formed in said side walls, and abutment means formed in said notch means, whereby said suspension means may be passed through said openings in said bottom wall, and may be inter engaged with said abutment means in said notch means.

The invention further comprises an alternate form of control apparatus wherein the drum body means is formed in two drum body portions, the two drum body portions being moveable relative to one another, whereby to clamp the cords between said two drum body portions, and incorporating locking means for holding said two drum body portions in a desired cord clamping position.

The invention further comprises such a control apparatus, and wherein said bearing support means comprises an integral one-piece thermoplastic structure, having a bottom wall portion adapted to be received within said head rail, and upstanding bearing flanges at either end of said bottom wall portion, and bearing recesses formed in said bearing flange means, at least one of said bearing recesses defining semi-annular bearing ring means for reception of bearings on said drum body means, said bearing ring means being upwardly open, whereby said bearing means on said drum body means may be press-fitted into said bearing means.

The invention further provides a control apparatus of the type described wherein said bottom wall means of said bearing means defines downwardly open anti-friction bearing means for passage of said suspension means therethrough.

The invention further comprises a window covering incorporating such a control apparatus.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
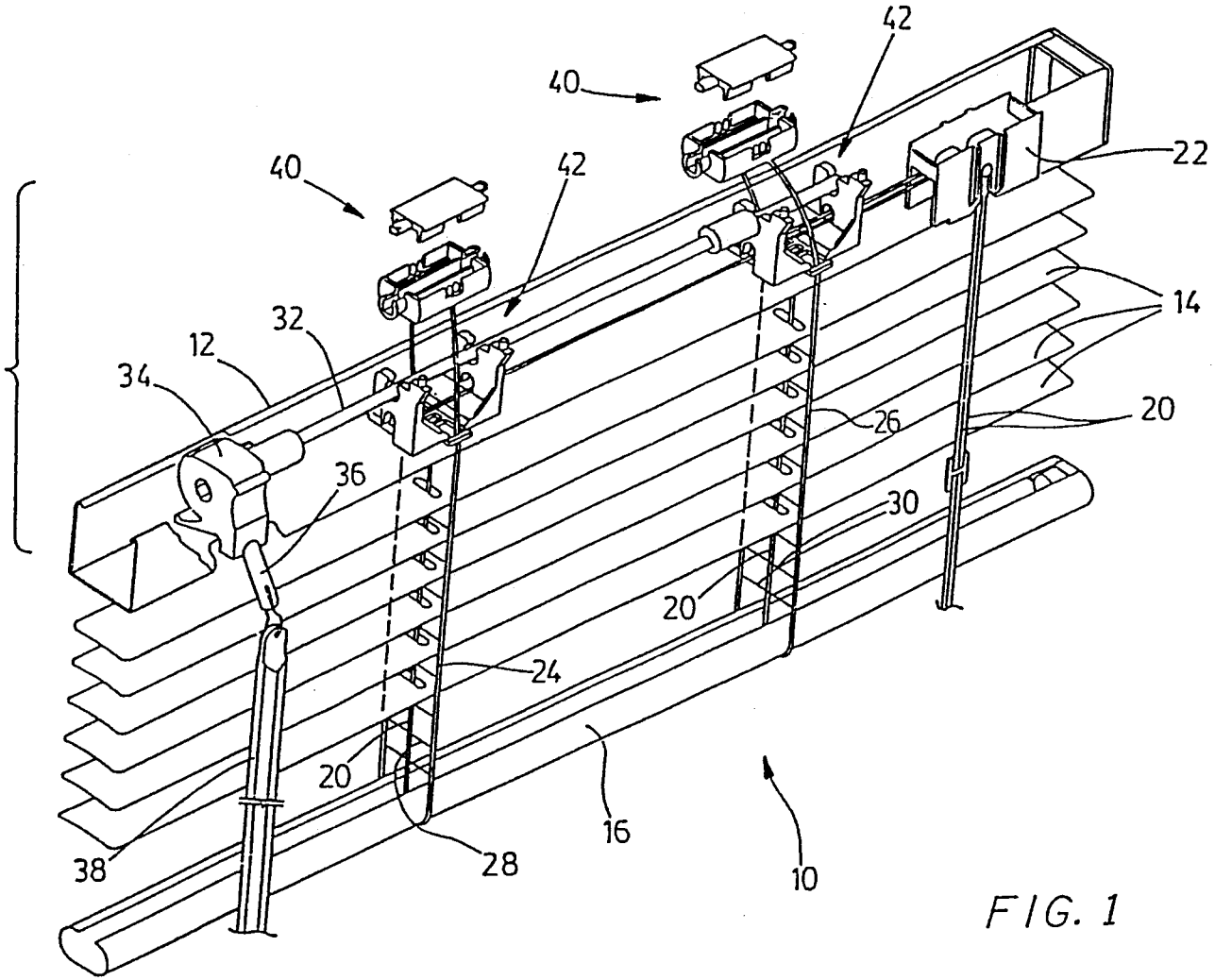
FIG. 1 is an exploded perspective illustration of a venetian blind assembly in accordance with the invention, shown with portions thereof exploded, and parts cut away for clarity.

Referring first of all to FIG. 1, it will be seen that this illustrates a window covering assembly which, in this case, is a venetian blind, which is illustrated here for the sake of example. As explained above, the invention is not confined solely to such venetian blinds but is of application to other window coverings where it is desired to provide some form of rotary control in a head rail.

The venetian blind is indicated generally as 10 and has a head rail 12, a plurality of blind slats 14, and a lower hollow rod member 16 Although not shown, it is well known in the art that the head rail 12 will be provided with suitable attachment means, for attaching it in, for example, a window opening or doorway opening or anywhere where it may be desired to erect a blind.

Also as is well known in the art, the slats 14 are provided with central openings 18, and a pair of "raise" cords 20—20, passing through a cord lock 22 at one end of the head rail 12.

At their free ends, the raise cords 20—20 are attached to the rod 16. Thus, by pulling on the raise cords 20—20, the rod 16 is pulled upwardly thereby raising all of the slats 14 upwardly and opening the blind. The cord lock device 22 incorporates in well known manner a roller locking mechanism (not shown), which may be released by manipulating the raise cords 20, so that the weight of the rod 16 will pull the two cords 20—20 downwardly, thereby allowing the slats 14 to be lowered, thus closing the blind.

Also, as is well known in the venetian blind art, the individual blind slats 14 are supported on at least two spaced-apart pairs of ladder cords or tapes 24-26. Although only two such ladder tapes are shown in this embodiment, more such ladder tapes may be provided in certain cases in the case of blinds having axially elongated slots. The pairs of cords 24-26 sometimes known as ladder tapes, are provided with spaced-apart horizontal "rungs" 28 and 30, on which the individual blind slats 14 are supported.

In FIG. 1, the rungs 28-30 are shown substantially horizontal so that the blind slats 14 themselves are also shown substantially horizontal. Again as is well known in the blind art, the objective of such blinds is such that the ladder cords 24 and 26 can be so manipulated that the rungs 28 and 30 can be tilted one way or the other so as to tilt the slats 14 one way or the other, so as to produce various different effects of light or shade in a particular space.

In the venetian blind art, it is usual to provide for this purpose a tilt control rod 32 extending transversely of the head rail 12. The tilt control rod 32 must be rotated, at least partially, to and fro, in order to produce the desired result. For this purpose, in some cases, a simple sprocket (not shown) is provided at one end, and an endless chain is provided on the sprocket, so that the tilt rod 32 can be rotated one way or the other.

In the embodiment as illustrated however, a worm and wheel gear drive system 34 is provided, being located within the head rail 12. The details of the gear and the worm drive are omitted, since they are well known in the art and require no special description. Typically, a gear drive shaft 36 will extend outwardly, and is connected by any suitable universal joint means to a wand 38. Rotation of the wand will thus cause rotation of the shaft 32.

Thus far, the venetian blind as described contains essentially all of the elements common to the majority of venetian blinds on the market at the present time. In accordance with the present invention, the window covering assembly as illustrated is provided with cord attachment devices indicated generally as 40—40, referred to generally as "control apparatus" herein, there being two such attachment devices illustrated in the present case. However, it will be appreciated that in some window coverings where there are more such cords provided, there will be more than two such cord attachment devices 40 provided. The cord attachment devices 40 are adapted in a manner yet to be described, to be secured on the tilt control rod 32, and to provide a secure means of attachment for the cords 24 and 26.

In the embodiment as illustrated, the attachment devices are adapted to be rotatable mounted in bearing assemblies indicated generally as 42—42 received in the head rail 12.

These components will now be described in more detail in connection with FIG. 2.

Figure 2:
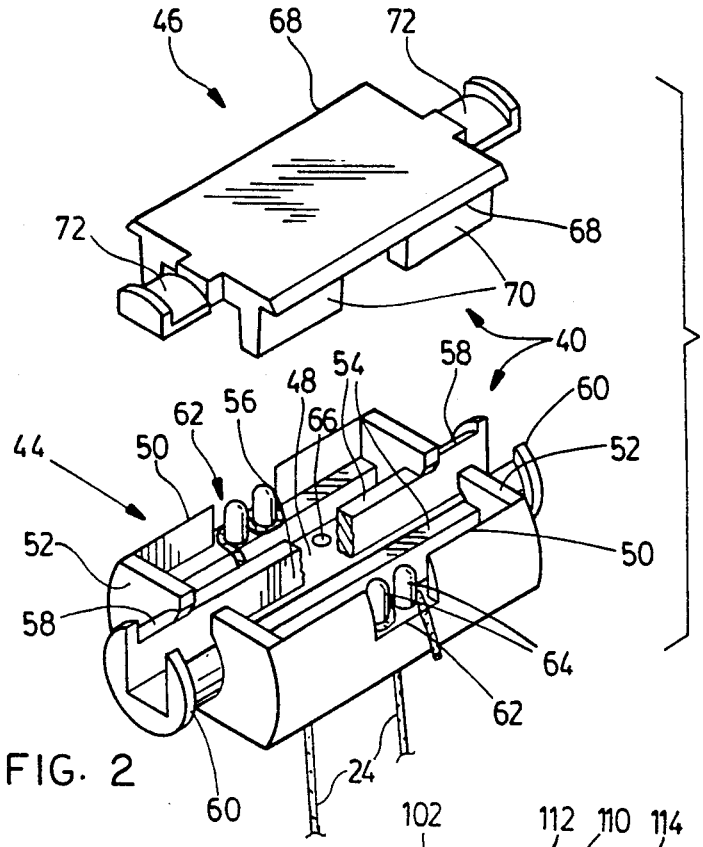
FIG. 2 is an enlarged exploded perspective illustration of the cord drum of FIG. 1.

As shown in FIG. 2, the cord attachment devices 40 each comprise a body portion 44, and a closure portion 46. The body portion 44 will be seen to comprise a bottom wall 48, and two side walls 50—50 having arcuate outer profiles. End walls 52—52 extend partially between side walls 50—50. Longitudinal interior channel walls 54-54 extend between end walls 52—52 and together therewith define an upwardly open central axial channel 56 of rectangular cross-section.

Generally cylindrical bearing bosses 58—58 extend outwardly from opposite ends of end walls 52, aligned with the axial recess 56.

Retention rings 60—60 may be provided on the outward free ends of bosses 58, in some cases, or may be omitted at one or both ends.

Each of side walls 50—50 is provided with a generally rectangular notch 62—62. Within notches 62, there are provided abutment posts 64—64 for reasons to be described.

In the bottom wall 48, openings 66 are formed, for passage of the blind control cords or tapes 24 or 26.

As also mentioned above, a top cover 46 is provided, having radiussed edge flanges 68—68, which are adapted to fit within the spacing between the walls 50—50, and downwardly dependent tongues 70—70 are formed to make a friction-fit around the walls 54—54.

Generally curved end bearing flanges 72—72 extend from either end, to mate with the axial opening 56, extending through each of the bearings 58.

In use, in this form of the invention, the cords or tapes of the ladders are led upwardly through the openings 66, and then are wrapped around the abutments 64 in the notches 62. The top panel 46 is then forcibly pressed downwardly so that the tongues 70 are forced alongside the walls 54. This will bring the edge flanges 68 down within the walls 50, thereby squeezing and sandwiching the cords or tapes securely, so that they are permanently fixed in position.

Figure 3:
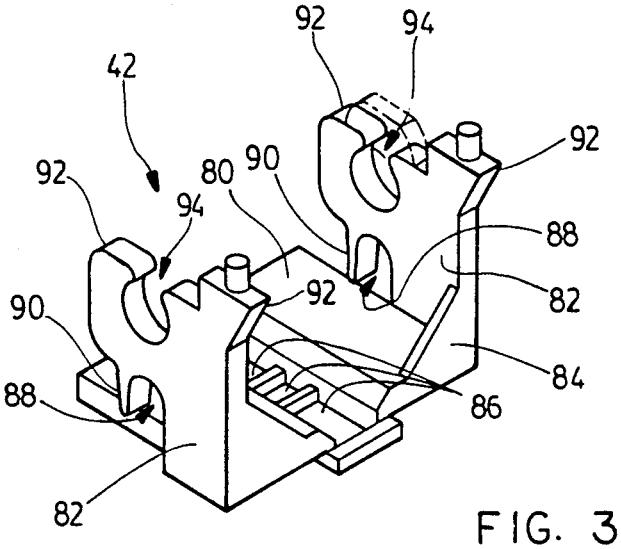
FIG. 3 is a perspective illustration of an embodiment of bearing for a drum assembly, and, FIG. 4 is a perspective of an alternate embodiment.

Referring now to FIG. 1, it will be seen that each of the cord retention devices 40 is adapted to be received in its own bearing support 42. FIG. 3 illustrates one embodiment of such a bearing support 42 in more detail. This embodiment comprises a bottom wall 80 and upstanding integral end bearing flanges 82—82, reinforced by triangular gusset portions 84.

The bottom wall 80 defines openings 86 for upward passage of raise cords and the ladder tapes, through the bottom of the head rail 12. The end bearing flanges 82 define axial openings 88, for passage of the raise cords. Preferably, one side wall 90 of the flanges 82 is incomplete, defining an opening, for easy insertion of the raise cords into the axial openings 88.

Retention shoulders 92—92 are formed on the flanges 82, for making a friction fit with the side walls of the head rail 12.

The bearing flanges 82 define axial bearing recesses 94.

Recesses 94 define an arc somewhat greater than a semi-circle, and the material of the flanges 82 is such that it will permit a certain degree of resilient opening of the recesses 94 so as to receive and snap around the bearings 58 on the retention devices 40.

In this way, it will be seen that the assembly of the blind in accordance with the invention is greatly facilitated, since the lower portions 44 attachment devices 40 can be placed on the control shaft 32. The raise cords and ladder cords can then be threaded upwardly through the openings in the head rail 12, and through the openings 86 in the bearing supports 42. The ladder cords can then be threaded through the openings 66 in the lower portions 44 of the cord holders.

Once the cords have been led through, then the cord holders 40 can be snapped into the bearing recesses 94, and the bearings 42 can then be press-fitted into the head rail 12.

The operator can then readily adjust the length of the raise cords and ladder cords as desired, and when a satisfactory adjustment has been achieved, the last operation will simply be the press fitting of the cover portion 46 into position on the bottom portion 44 to complete the cord holders 40.

This sequence of operations will thus greatly facilitate and speed up the assembly and adjustment of blinds of this type, and at the same time will produce a more satisfactory end result, since the adjustment of the lengths of the cords is much easier than with any other design of prior art blind. Various other embodiments of the invention may be provided in various circumstances. For example, as shown in phantom in FIG. 3, a modification may be made in that a modified form of bearing assembly may be provided, having an open bearing recess at one end, and a completely closed bearing ring 96 at the other end. In this case, the cord holder may have a bearing with or without a flange at one end, and a modified bearing at the other end without a flange.

The bearing is formed without a flange so that it may be inserted axially into the closed ring 96, after which the other bearing may be snap-fitted down into the open-sided bearing recess.

Figure 4:
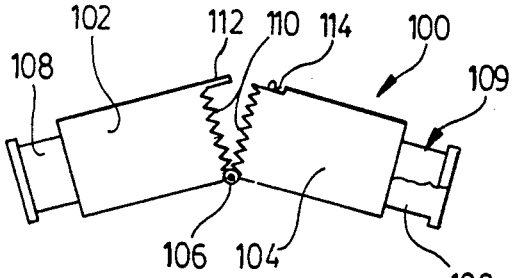

Referring now to FIG. 4, an alternate form of cord holder 100 is illustrated. In this alternate form of cord holder, the cord holder comprises two holder portions 102 and 104. They are hingedly mounted as by hinge means 106 for example or by an integrally moulded hinge, so that they be swung towards and away from one another.

Each of the portions 102 and 104 has an end bearing 108 extending therefrom, and both portions 102 and 104 define an axially extending slot 109 for receiving the drive shaft mentioned above, essentially in the same fashion as the cord holder of FIG. 2.

In order to lock the cords in this embodiment, serrations or teeth 110 are formed on the adjacent faces of the portions 102 and 104, so that when the two portions 102 and 104 are swung together the teeth essentially interlock or interdigitate. In this way, the cords can be led between the teeth 110, and then when the two portions are swung together the cords will be held securely.

The two portions may be locked in position for example by the locking tongue 112, and the recess 114.

As before, in this embodiment, the bearings at each end of the cord holder may be made either with or without retaining flanges, and may be utilized either in a bearing having two upwardly open bearing recesses as illustrated in FIG. 3 or in a bearing having only one upwardly open recess and one closed bearing ring as illustrated in phantom at 96 in FIG. 3.

It will of course be appreciated that in either embodiment, since the pull of the cords is downwardly, once the drum body has been locked in position in its respective bearing rings, and is positioned on the axial drive shaft or tilt rod, there is substantially no possibility of the drum body either sliding along the tilt rod, or from becoming displaced from the bearing ring or from being dislodged from the tilt rod. The combination of the tilt rod with the drum body and the bearings on the drum body and the bearing rings retaining the bearings in position, and encircling the drive shaft, will secure the drum body in position on its own.

It will thus be seen that the invention and its various embodiments provides a greatly improved form of control apparatus, which both facilitates manufacture in a smaller number of parts, and also facilitates the assembly of the parts into the blind, and also facilitates the adjustment of the length of the raise cords and ladder tapes, so that the blind can be adjusted substantially perfectly every time with a minimum of training on the part of the operator.

The invention also provides as a part of such a control apparatus a variety of designs of bearing, offering advantages in manufacture, in assembly and use.

At the same time, the parts being formed of moulded thermoplastic material are self-lubricating, and are essentially good for the life of the blind, and except in the case of exceptionally abusive misuse, there is little or no likelihood of failure.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A control apparatus in association with a window covering assembly having a head rail, and suspension means extending downwardly from said head rail upon which said window covering is suspended, a control shaft adapted to extend a predetermined distance along the length of said head rail, and means associated therewith for rotating the same, suspension opening means in said head rail whereby suspension means may extend upwardly from said window covering into said head rail, and said control apparatus comprising:

attachment drum body means, attachable on said shaft at spaced intervals therealong, and adapted to register with said openings for said suspension means in said head rail;

means in said drum body means for receiving said suspension means;

a generally elongated slot formed along said drum body means, whereby the same may be positioned on said control shaft and wherein said drum body means defines two drum body portions, moveable towards and away from one another, and cord clamping means associated with said portions, whereby when the same are moved together they will clamp said cord means therebetween said drum body means having cylindrical bearings extending from opposing ends thereof, each of said bearings comprising portions of each of said two drum body portions.

2. A control apparatus as claimed in claim 1 and wherein said drum body means incorporates bearing means extending therefrom, and including bearing support means adapted to be supported in said head rail, and inter-engagable with said bearing means on said drum body means whereby to rotatably support the same.

3. A control apparatus as claimed in claim 1 and wherein said drum body means incorporates a bottom wall and side walls, and opening means being formed in said bottom wall, and notch means formed in said side walls, and abutment means formed in said notch means, whereby said suspension cords may be passed through said opening means in said bottom wall, and may be interengaged with said abutment means in said notch means.

4. A control apparatus as claimed in claim 2 and wherein said bearing support means comprises an integral one-piece thermoplastic structure, having a bottom wall portion adapted to be received within said head rail, and upstanding bearing flanges at either end of said bottom wall portion, and bearing recesses formed in said bearing flanges said bearing recesses being adapted for reception of bearings on said drum body means, at least one of said bearing recesses being upwardly open, whereby said bearing means on said drum body means may be press-fitted into said at least one upwardly open bearing recess.

5. A control apparatus as claimed in claim 4 and wherein one of said bearing flanges defines an upwardly open semi-annular bearing ring means, and the other of said bearing flanges defines a completely annular bearing ring recess, and wherein said drum body means defines first bearing means adapted to be press-fitted into said upwardly open bearing recess and second bearing means is adapted to be inserted longitudinally into said annular bearing ring means.

6. A control apparatus as claimed in claim 2 wherein said bottom wall means of said bearing support defines downwardly open anti-friction means for passage of blind control elements therethrough.

7. A control apparatus in association with a window covering assembly having a head rail, and suspension means extending downwardly from said head rail upon which said window covering is suspended, a control shaft adapted to extend a predetermined distance along the length of said head rail, and means associated therewith for rotating the same, suspension opening means in said head rail whereby suspension means may extend upwardly from said window covering into said head rail, and said control apparatus comprising:

attachment drum body means, attachable on said shaft at spaced intervals therealong, and adapted to register with said openings for said suspension means in said head rail; means in said drum body means for receiving said suspension means;

a generally elongated slot formed along said drum body means, whereby the same may be positioned on said control shaft and wherein said drum body means defines left and right drum body portions, moveable towards and away from one another, and cord clamping means associated with said portions, whereby when the same are moved together they will clamp said cord means therebetween, wherein said left and right drum body portions are swingably moveable towards and away from one another, and hinge means are connected between said portions.

8. A window covering assembly comprising;

a head rail, and suspension means extending downwardly from said head rail upon which said window covering is suspended;

a control shaft adapted to extend a predetermined distance along the length of said head rail;

means associated therewith for rotating the same;

suspension opening means in said head rail whereby suspension means may extend upwardly from said window covering into said head rail;

attachment drum body means, attachable on said shaft at spaced intervals therealong, and adapted to register with said openings for said suspension means in said head rail;

opening means in said drum body means for receiving said suspension means;

a generally elongated slot formed along said drum body means, whereby the same may be positioned on said control shaft, and wherein said drum body means defines two drum body portions, moveable towards and away from one another, and cord clamping means associated with said portions, whereby when the same are moved together they will clamp said cord means therebetween said drum body means having cylindrical bearings extending from opposing ends thereof, each of said bearings comprising portions of each of said two drum body portions.

9. A window covering assembly as claimed in claim 9 and wherein said drum body means incorporates bearing means extending therefrom, and including bearing support means adapted to be supported in said head rail, and inter-engagable with said bearing means on said drum body means whereby to rotatably support the same.

10. A window covering assembly as claimed in claim 8 and wherein said drum body means incorporate a bottom wall and side walls, said opening means being formed in said bottom wall, and notch means formed in said side walls, and abutment means formed in said notch means, whereby said suspension cords may be passed through said openings in said bottom wall, and may be inter engaged with said abutment means in said notch means.

11. A window covering assembly as claimed in claim 9 and wherein said bearing support means comprises an integral one-piece thermoplastic structure, having a bottom wall portion adapted to be received within said head rail, and upstanding bearing flanges at either end of said bottom wall portion, and bearing recesses formed in said bearing flange for reception of bearings on said drum body means, at least one said bearing recesses being upwardly open, whereby said bearing means on said drum body means may be press-fitted into said upwardly open bearing recess.

12. A window covering assembly as claimed in claim 11 and wherein one of said bearing flanges defines an upwardly open semi-annular bearing recess, and the other of said bearing flanges defines a completely annular ring recess, and wherein said drum body means defines first bearing means adapted to be press-fitted into said upwardly open recess and second bearing means adapted to be inserted longitudinally into said annular bearing recess.

13. A window covering assembly as claimed in claim 9 wherein said bottom wall portion of said bearing support means defines downwardly open anti-friction bearing means for passage of blind control elements therethrough.

14. A control apparatus as claim in claim 3 including locking means for locking said two drum body portions in cord clamping position.

* * * * *